US006910802B2

(12) United States Patent
Rustioni

(10) Patent No.: US 6,910,802 B2
(45) Date of Patent: Jun. 28, 2005

(54) WATCH WINDING DEVICE

(75) Inventor: Alessandro Rustioni, Vaglia (IT)

(73) Assignee: Underwood (London) Ltd., London (GB)

( * ) Notice: Subject to any disclaimer, the term of this patent is extended or adjusted under 35 U.S.C. 154(b) by 199 days.

(21) Appl. No.: 10/203,607

(22) PCT Filed: Mar. 19, 2001

(86) PCT No.: PCT/IB01/00482

§ 371 (c)(1),
(2), (4) Date: Oct. 16, 2002

(87) PCT Pub. No.: WO01/71435

PCT Pub. Date: Sep. 27, 2001

(65) Prior Publication Data

US 2003/0076748 A1 Apr. 24, 2003

(30) Foreign Application Priority Data

Mar. 20, 2000 (EP) ..... 00810239

(51) Int. Cl.[7] ..... G04B 3/12
(52) U.S. Cl. ..... 368/206; 81/7.5
(58) Field of Search ..... 368/10, 206–213, 368/49–50, 327; 81/7.5

(56) References Cited

U.S. PATENT DOCUMENTS

| | | | | | |
|---|---|---|---|---|---|
| 3,620,007 | A | | 11/1971 | Kauffman | |
| 5,608,693 | A | | 3/1997 | Richards | |
| 5,988,871 | A | * | 11/1999 | Bonnet | 368/206 |
| 6,439,761 | B1 | * | 8/2002 | Agnoff | 368/206 |
| 6,543,929 | B1 | * | 4/2003 | Agnoff | 368/206 |

* cited by examiner

*Primary Examiner*—Vit Miska
*Assistant Examiner*—Jeanne-Marguerite Goodwin
(74) *Attorney, Agent, or Firm*—Hughes Hubbard & Reed LLP

(57) ABSTRACT

Automatic watches use the movements of the wrist to re-wind the barrel spring and thus supply the necessary energy for the correct functioning of the watch. When the user cannot wear the watch it is proposed to place it on an automatic re-winding device. The device according to the invention is compact and modular. Furthermore, in order to avoid any error of manipulation, the starting and stopping of the re-winding device is done automatically by means of a detection of the presence of the watch (3). The passing of the strap in the detachable base (2) produces the tension of the device.

7 Claims, 1 Drawing Sheet

WATCH WINDING DEVICE

BACKGROUND OF THE INVENTION

1. Field of the Invention

The present invention concerns a re-winding device of a watch, particularly for re-winding an automatic watch.

2. Description of Related Art

Such watches work on the principle of movement of the wrist of the user to transmit the necessary energy to the barrel. This movement allows an oscillating mass to drive a set of rotors that, by means of the demultiplication, can supply the energy in order to re-wind the spring of the barrel.

There are mainly two types of oscillating masses for automatic watches, either the complete rotation mass or the limited rotation mass. There are also the masses whose pivoting point is decentred with reference to the axis of the watch.

These differences imply that the movement of an artificial system tending to imitate the movement of the wrist must be compatible with all the automatic watches sold in the shop.

The automatic winding mechanisms are intended to keep an automatic watch operational even when its owner is not wearing it. This is particularly important for watches that have a perpetual calendar, whose stopping would mean taking it to the watchmaker in order to replace the numerous resorts in the day cycle.

This is why these watches, which are bought mainly by passionate collectors, usually are supplied directly in a box that ensures the periodic re-winding of the watch.

These boxes are manufactured in a luxurious way so as to give value to the object they contain. Such an automatic re-winding box, of the type with an electric motor, comprises a detachable base on which is placed the wristwatch, and a driving device ensured by a motor. This motor is powered by one or several batteries that generally ensure a working life of several months for the unit.

Such a device is described in the document U.S. Pat. No. 4,057,958, device that has a motor that ensures the rotation of a watch assembled on a detachable base.

A first inconvenience of this type of setting is its dimensions that rapidly discourage potential buyers. Another inconvenience is the little attractiveness of a watch assembled on such a device. In fact, it is not easy to see the object when it is placed on the base. This point is particularly important in a shop that offers a great number of these watches.

Another inconvenience is its continuous functioning, although it is at a low speed. This implies a permanent current consumption and the need to stop the motor to take the watch from its base.

Improvements of this device have been proposed that work in intermittent mode, that is, that the device has rotation phases and stop phases.

As a consequence of this the user is accustomed to seeing the re-winding device stopped without this being abnormal. For this reason it often happens that the users forget to start the re-winding device or inversely to stop it when it is not in use. The consequences can be serious if the re-winding device does not fulfil its mission.

BRIEF SUMMARY OF THE INVENTION

The objective of the present invention is to avoid the abovementioned inconveniences, that is, to supply an automatic re-winding device that is compact and modular and that ensures a great security for its use.

This objective is achieved by a watch re-winding device that comprises a detachable base destined to receive the watch, a motor that rotates said base and commanding means of the motor. These means comprise a presence detector of the watch that commands the functioning of the device.

In this way, by means of this presence detector of the watch, the user no longer has to worry about knowing if the re-winding device is on or off; the functioning is ensured from the moment the watch is in place.

This configuration offers the advantage of eliminating the main switch that could be accidentally activated by movement.

According to a first embodiment, the drum driven by the motor includes a detachable base on which is placed the watch that is to be rewound. On this base is an element that allows to adjust the perimeter of the base to the length of the watch's strap. For this purpose it has a retractile part mounted on it. The detector is activated from the moment the retractile part leaves its stop position.

This information is transmitted from the detachable base to the drum by means of two metallic axes that offer support for the drum. The detector closes the circuit between the two axes, in this way giving the order to the electronic command to begin working.

There are other ways of achieving this result, for example, the bias of a clamping spring assembled on the drum. This spring is located in the passage of the strap and closes a contact from the moment a watch strap is placed in position.

This information, once it is on the drum, is transmitted to the fixed part of the re-winding device either by a brush collector or by an optical sensor.

According to another aspect of the invention, the re-winding device is placed at wish in a compact and modular box. Thanks to this form, it is easy to place side by side several of these boxes in order to display a presentation of automatic watches, for example, for a collection.

Another advantage of the configuration according to the invention is that for the first time it can be used in large scale for the shops that offer such watches. In fact, the general cubic shape of these boxes allows the gathering of a great number of them in a reduced space.

In order to make this re-winding device easily transportable it is established to power it by a set of batteries. These batteries are prepared for a working life of about one year.

According to another aspect of the invention the modularity of these re-winding devices allows to make current rails for several boxes. Each unit comprises an electric inlet in its back side allowing a plug that is mounted on the rail to supply the driving mechanism of the watch by an external supply, instead of the internal supply.

This configuration offers the advantage of not needing the batteries until the re-winding device is separated from the current rail.

According to another aspect of the invention, the rotation cycle of the watch is not continuous but presents rotation phases in one direction and then in the reverse direction, as well as a stop phase. In fact, it is not necessary to make the watch rotate permanently to ensure its well functioning. For this reason the watch is immobile during a great length of time.

One of the characteristics of the re-winding device according to the invention is stopping the rotation cycle in a well defined position, usually in vertical position. Because of this, the watches that are not rotating are all in an optimal position for presentation. If the modules are placed in such a way as to form a pyramid it could be wise to tilt the watches backwards so as to follow the line of the pyramid.

According to another embodiment, the different modules are linked by a control bus that allows to synchronise a set of modules. In this way it is possible to start all the modules at the same time and to set off the cycle changes in a global way.

This way of functioning allows the formation of figures by using the different modules, for example, to form letters with the position of the watches when stopped. In this type of functioning, a centre administers the set of modules in order to communicate the positioning orders to them. This is carried out by means of a bus that passes from one module to another creating a chain.

BRIEF DESCRIPTION OF THE SEVERAL VIEWS OF THE DRAWINGS

The invention will be better understood with the aid of the following detailed description, making reference to the annexed drawings which are given as a non-limiting example, in which.

DETAILED DESCRIPTION OF THE INVENTION

On the front side of the module is a first green LED 5 to indicate the good functioning of the re-winding device. This luminous indicator is not continuous as the current consumed by the LED is greater than the consumption of the motor, and thus lessens considerably the working life of the batteries. This is why the functioning indication by the green LED 5 is given by means of a slow flashing, for example, one flash every 4 seconds.

In order to indicate the user that the batteries are running out of power a second red luminous indicator is supplied. In the same way as the functioning indicator, this power indicator of the batteries is intermittent.

Figure 1:
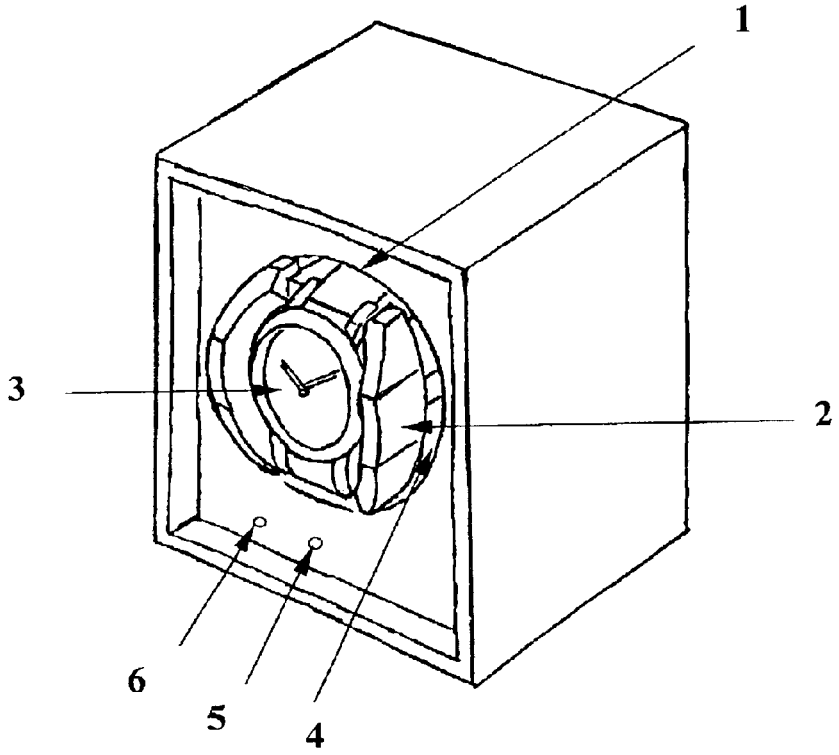
FIG. 1 represents the re-winding device according to the invention in its modular form.
Figure 2:
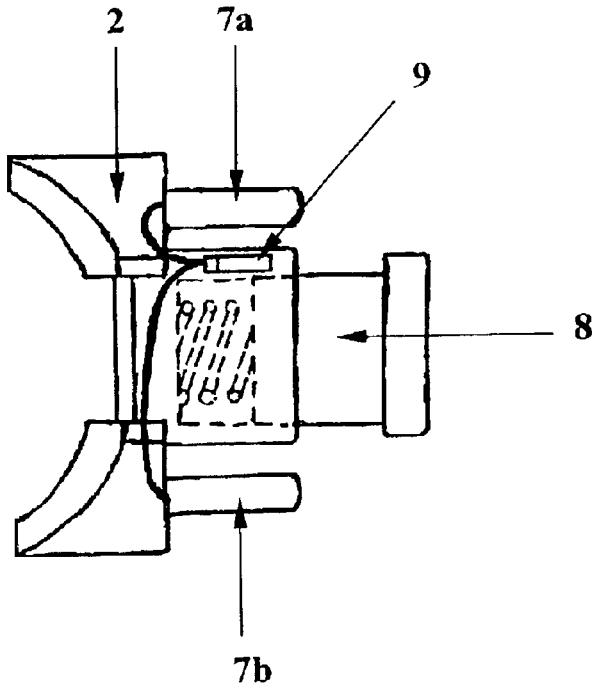
FIG. 2 represents the base on which the watch is fixed to allow an easy stacking. This module comprises a circular opening 1 in which is placed a watch base 2. This base is detachable in order to easily show the watch 3. The base 2 is then slid in the drum 4.

In FIG. 2 we find the base of the watch 2 when it is separated from the module. In this way, this base is characterised by a simple assembly without lock and using the two axes 7*a* and 7*b* which adjust in two orifices of the drum 4 supplied for this purpose. The adjustment between the axes and the orifices is push fit.

The back side of the watch 2 comprises a sliding part 8 that allows to adjust the perimeter of the base according to the length of the watch's strap. When the watch is introduced, this sliding part 8 is compressed in order to allow the placing of the watch with its strap closed. Once in place, the sliding part tensions the strap and in this way adapts to the whole length of the strap.

As indicated above, according to a form of execution, it is this compression that activates a detector 9 which locates the presence of the watch. This detector is presented in the form of a contactor that links electrically the two axes 7*a* and 7*b*.

The orifices placed on the drum 4 receive the two axes and are supplied with electric contacts that allow the use of information of the detector.

To stop the watch in a particular position, the drum on which is assembled the base of the watch comprises an optical indication of the position, for example, a set of bar codes. On the fixed part is placed an optical sensor that will read these indications and will communicate them to the electronics of the motor command.

The compact and modular form of the re-winding devices according to the invention allow a luxurious presentation. In this case, the module is placed on a leather base, for example, with a lid provided especially for transport.

What is claimed:

1. An automatic re-winding device of a watch, comprising a detachable base intended to receive the watch and assembled on a drum;

a motor driving rotationally the drum;

means for commanding the motor;

wherein the commanding means comprises detection means for determining the presence of the watch and means for starting or stopping the re-winding device depending on the information supplied by the detection means.

2. A re-winding device according to claim 1, wherein the detachable base comprises a sliding part that adjusts to the length of the strap of the watch, and the detection means detects the stop position of the sliding part.

3. A re-winding device according to claim 2, wherein the detachable base comprises at least two metallic surfaces in contact with two other metallic surfaces placed on the drum transmitting the information supplied by the detection means.

4. A re-winding device according to claim 1, wherein the detection means is assembled on the drum at the level of the passage of the watch's strap.

5. A re-winding device according to claims 1, 2, 3, or 4, wherein the detachable base is assembled push fit in the drum driven by the motor.

6. A re-winding device according to claim 5, which is assembled in a compact and modular box and wherein the commanding means of the motor comprises a sensor of the position of the detachable base allowing to stop the rotation of the motor in a particular position.

7. A re-winding device according to claim 6, which further comprises an autonomous energy source, an inlet for receiving an external energy supply, and means to disconnect the autonomous energy source when the re-winding device is powered by the external energy supply.

* * * * *